US008923723B2

(12) United States Patent
Hirakawa et al.

(10) Patent No.: US 8,923,723 B2
(45) Date of Patent: Dec. 30, 2014

(54) DEVELOPING DEVICE AND IMAGE FORMING APPARATUS COMPRISING SAME

(71) Applicant: KYOCERA Document Solutions Inc., Osaka (JP)

(72) Inventors: Hiroyuki Hirakawa, Osaka (JP); Eiji Tatsumi, Osaka (JP); Kenshi Matsui, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 76 days.

(21) Appl. No.: 13/667,745

(22) Filed: Nov. 2, 2012

(65) Prior Publication Data

US 2013/0108310 A1 May 2, 2013

(30) Foreign Application Priority Data

Nov. 2, 2011 (JP) ..... 2011-240753

(51) Int. Cl.
*G03G 15/08* (2006.01)
*G03G 15/09* (2006.01)

(52) U.S. Cl.
CPC ..... *G03G 15/0898* (2013.01); *G03G 15/09* (2013.01); *G03G 2221/1645* (2013.01)
USPC ..... 399/98; 399/92; 399/279

(58) Field of Classification Search
USPC ..... 399/92, 93, 98, 99
See application file for complete search history.

(56) References Cited

U.S. PATENT DOCUMENTS 6,067,428 A * 5/2000 Zirilli et al. ..... 399/92
7,043,172 B2 * 5/2006 Koshimura et al. ..... 399/99
7,103,298 B2 * 9/2006 Satoh ..... 399/98
7,171,137 B2 * 1/2007 Lee et al. ..... 399/98
7,620,342 B2 * 11/2009 Sata ..... 399/92
7,991,318 B2 * 8/2011 Tamura et al. ..... 399/92
2011/0229184 A1 9/2011 Kashimoto et al.

FOREIGN PATENT DOCUMENTS

JP H-11-231652 A 8/1999
JP 2002-278268 A 9/2002
JP 2008-225274 A 9/2008
JP 2010-276954 A 12/2010
JP 2011-197290 A 10/2011

OTHER PUBLICATIONS

English language Abstract and Machine Translation for JPH-A-11-231652 , published Aug. 27, 1999.
English language Abstract and Machine Translation for JP 2008-225274 A, published Sep. 25, 2008.

* cited by examiner

*Primary Examiner* — Clayton E Laballe
*Assistant Examiner* — Leon W Rhodes, Jr.
(74) *Attorney, Agent, or Firm* — NDQ&M Watchstone LLP

(57) ABSTRACT

The developing device of the present disclosure comprises a developing container, toner carrier, developer carrier, regulating member, and air outflow channel. The developing container accommodates a two-component developer. The toner carrier supplies toner to an image carrier. The developer carrier rotates so that a surface facing the toner carrier moves in the opposite direction of the toner carrier, and a toner layer is formed on the toner carrier. The regulating member regulates the amount of developer carried on the developer carrier. The air outflow channel communicates an airflow outlet formed in the top end of the developing container facing the toner carrier with the interior of a duct placed above the developing container, and the air outflow channel is inclined downstream in the rotational direction of the toner carrier relative to a straight line passing through the rotational axis center of the toner carrier and the airflow outlet.

9 Claims, 9 Drawing Sheets

DEVELOPING DEVICE AND IMAGE FORMING APPARATUS COMPRISING SAME

INCORPORATION BY REFERENCE

This application is based on Japanese Patent Application No. 2011-240753 (Nov. 2, 2011), the contents of which are hereby incorporated by reference.

BACKGROUND

The present disclosure relates to a developing device which uses a two-component developer containing a magnetic carrier and a toner and supplies the toner to an image carrier. The present disclosure also relates to an electrophotographic image forming apparatus comprising this developing device.

In an electrophotographic image forming apparatus, light based on image information read from a document image or image information transmitted or otherwise delivered from a computer or another external machine is radiated onto the peripheral surface of an image carrier (a photosensitive drum) on which a photosensitive layer is formed, an electrostatic latent image is formed, toner is supplied to the electrostatic latent image from a developing device to form a toner image, and the toner image is then transferred onto paper. After this transfer process, the paper undergoes a process of fixing the toner image and is then ejected to the exterior.

Recently, the configurations of image forming apparatuses have grown complex along with the advancement of color printing and high-speed processing, and adapting to high-speed processing has necessitated high-speed rotation of the toner stirring member inside the developing device, whereby the internal pressure of the developing device is likely to be a positive pressure higher than atmospheric pressure. When the developing device interior has a positive pressure and toner from the developing device interior is supplied to the photosensitive drum, some of the toner leaks as scattered toner out of an opening (a toner supply hole) in the developing device that faces the photosensitive drum, and the interior of the image-forming apparatus is contaminated.

Particularly, with a developing system that uses a two-component developer containing a magnetic carrier and a toner, and that also uses a magnetic roller (a developer carrier) for carrying the developer and a developing roller (a toner carrier) for carrying only the toner, toner that has not been used in the developing is stripped away from the developing roller by a magnetic brush formed on the magnetic roller in the facing portion of the developing roller and the magnetic roller. Therefore, the toner readily floats in the vicinity of the facing portion of the developing roller and the magnetic roller, and the floating toner leaks out as scattered toner. Floating toner that has accumulated in the interior of the developing device forms clumps and falls down onto the developing roller, disrupting the thin layer of toner on the developing roller, thereby readily causing problems such as "dropping toner," in which toner is not supplied to the portion where toner should be adhering in the peripheral surface of the photosensitive drum.

A known technique for resolving problems such as the one described above involves forcefully drawing in the air in the gap between the toner carrier and a covering member for covering part of the external peripheral surface of the toner carrier, whereby toner scattering and heat generation in the developing device are suppressed even if the developing step carried out at a higher speed.

However, this developing apparatus is a developing system that supplies the photosensitive drum with the toner in the two-component developer supplied onto the developing roller from a stirring screw and that does not have a developer carrier and a toner carrier. The portion where positive pressure arises in the developing device differs depending on whether or not there is a developer carrier, as does the extend of the positive pressure arising.

Consequently, with a method of forcefully drawing in the air in the gap between the toner carrier and the covering member for covering part of the external peripheral surface of the toner carrier as described above, it has not been possible to effectively resolve the problem of floating toner in the space enclosed by the developer carrier, the toner carrier, and the inner surface of the developing container, which is a phenomenon unique to developing systems that have a developer carrier and a toner carrier. Because the above method uses a configuration in which an airflow including the floating toner passes over an restricting blade, there is a risk of dropping toner leading to image flaws when floating toner accumulates on the blade and the accumulated toner aggregates and adheres to the toner carrier.

Also known is a developing device in which the wall of the developing container that faces below the toner carrier is provided with an airflow inlet for taking in air from outside the developing device, whereby an airflow flowing from the outside of the developing container to the inside flows into the negative-pressure vicinity of the restricting blade, and the incoming airflow causes the floating toner in the vicinity of the restricting blade to be carried by the rising airflow, thereby preventing the accumulation of toner on the restricting blade.

According to this method, the flow of air in from the airflow inlet provided to the wall of the developing container that faces below the toner carrier makes it possible to reduce the pressure of the portion that has positive pressure due to the rotation of the developer carrier and the toner carrier and to suppress the leaking of developer. The incoming airflow is joined with the rising airflow, whereby the floating toner in the vicinity of the restricting blade is carried by the rising airflow and the accumulation of toner on the restricting blade can be prevented.

However, despite the inclusion of the airflow inlet, when the speed of the image forming apparatus main body is increased and there is a large amount of floating toner, it has been difficult for the floating toner to be sufficiently carried by the airflow created by the rotation of the developer carrier and the toner carrier, and it has also been difficult for the accumulation of toner to be sufficiently prevented. With a configuration having an airflow inlet provided to the wall of the developing container that faces below the toner carrier, although it is possible to resolve the problem of floating toner in the vicinity of the restricting blade positioned below the facing portion of the developer carrier and the toner carrier, it has not been possible to effectively prevent the external leaking of floating toner that occurs in the space enclosed by the developer carrier, the toner carrier, and the top surface of the developing container.

Furthermore, also known is an image forming apparatus in which a through-hole for taking in air from outside of the developing device is provided in the wall of the developing container that faces below the toner carrier, and an air ejection hole communicated with the duct is provided in the top end of the developing container above the border between the toner carrier and the developer carrier.

According to this method, airflows from the through-hole of the developing container that faces below the toner carrier to the duct via the air ejection hole provided in the top end of the developing container, whereby floating toner present in the space enclosed by the developer carrier, the toner carrier, and the inner surface of the developing container can be effectively ejected even when there is a large amount of floating toner.

However, with this method, when all of the floating toner present is drawn into the duct from the air ejection hole, there have been problems with the toner accumulating in the duct, clogging becoming severe in the filter attached to the ejection hole side of the duct and leading to numerous filter replacements, and the like. When drawing the floating toner into the duct is insufficient, there has been a risk of the floating toner leaking out to the exterior through the opening in the developing device, and toner contamination occurring in the interior of the image forming apparatus.

SUMMARY

An object of the present disclosure is to provide an image forming apparatus wherein leaking of the toner from the developing device can be effectively prevented, and excessive drawing of the toner into the duct for drawing in the toner in the developing container can be suppressed.

The developing device according to a first aspect of the present disclosure comprises a developing container, a toner carrier, a developer carrier, a regulating member, and an air outflow channel. The developing container accommodates a two-component developer containing a magnetic carrier and a toner. The toner carrier has some of an external peripheral surface exposed through an opening in the developing container, whereby the toner carrier is arranged so as to face an image carrier. The toner carrier supplies toner to the image carrier while rotating so that the surface facing the image carrier moves upward. The developer carrier is placed facing the toner carrier, the developer carrier rotating so that a surface facing the toner carrier moves in the opposite direction of the toner carrier, and a toner layer is formed on the toner carrier using a magnetic brush comprising a two-component developer carried on a surface of the developer carrier. The regulating member regulates the amount of developer carried on the developer carrier. The air outflow channel communicates an airflow outlet formed in the top end of the developing container facing the toner carrier with the interior of a duct placed above the developing container, and the air outflow channel is inclined downstream in the rotational direction of the toner carrier relative to a straight line passing through the rotational axis center of the toner carrier and the airflow outlet.

Other objects of the present disclosure and specific merits achieved by the present disclosure will be further clarified from the description of the embodiments described hereinbelow.

DETAILED DESCRIPTION

Figure 1:
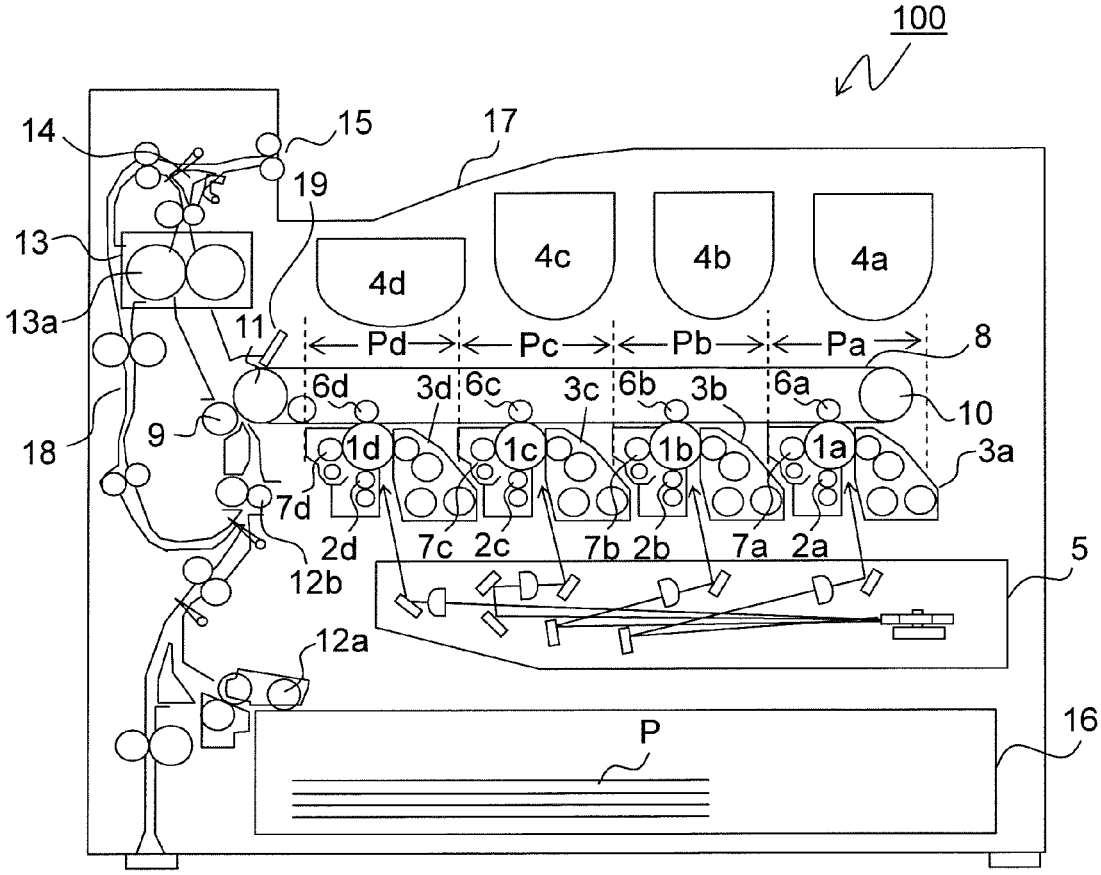
FIG. 1 is a schematic configuration drawing of a color printer 100 equipped with developing devices 3*a* to 3*d* according to the first embodiment of the present disclosure.

Embodiments of the present disclosure are described hereinbelow with reference being made to the accompanying drawings. FIG. 1 is a schematic cross-sectional view of an image forming apparatus equipped with the developing device of the present disclosure, wherein a tandem color printer 100 is shown. Inside the main body of the color printer 100, four image formation parts Pa, Pb, Pc, and Pd are arranged in sequence from the upstream side in the transporting direction (the right side in FIG. 1). These image formation parts Pa to Pd are provided corresponding to images of four different colors (magenta, cyan, yellow, and black), and images of magenta, cyan, yellow, and black are formed sequentially by the steps of electric charging, exposure, developing, and transferring.

Arranged on these image formation parts Pa to Pd are photosensitive drums 1*a*, 1*b*, 1*c*, and 1*d* for carrying visible images (toner images) of each color. Furthermore, an intermediate transfer belt 8 rotated clockwise in FIG. 1 by drive means (not shown) is provided adjacent to the image formation parts Pa to Pd. Having been formed on the photosensitive drums 1*a* to 1*d*, the toner images are sequentially primary-transferred to and superimposed on the intermediate transfer belt 8 which is moving while in contact with the photosensitive drums 1*a* to 1*d*, after which the toner images are secondary-transferred onto a transfer paper P as an example of a recording medium by the action of a secondary transfer roller 9. Furthermore, the toner images are fixed on the transfer paper P in a fixing part 13, and the transfer paper P is then ejected out of the main body of the color printer 100. An image formation process is executed on the photosensitive drums 1*a* to 1*d* while the photosensitive drums 1*a* to 1*d* are rotated counterclockwise in FIG. 1.

The transfer paper P on which the toner images are transferred are accommodated in a paper cartridge 16 in the bottom of the device, and are transported via a paper-feeding roller 12*a* and a pair of resist rollers 12*b* to a nip portion between the secondary transfer roller 9 and a drive roller 11 (described below) of the intermediate transfer belt 8. For the intermediate transfer belt 8, a sheet made of a dielectric resin is used, and a belt having no seams (a seamless belt) is primarily used. A blade-shaped belt cleaner 19 for removing toner and the like remaining on the surface of the intermediate transfer belt 8 is placed on the downstream side of the secondary transfer roller 9.

Next, the image formation parts Pa to Pd will be described. Provided around the peripheries and beneath the rotatably arranged photosensitive drums 1*a* to 1*d* are electric chargers 2*a*, 2*b*, 2*c*, and 2*d* for electrically charging the photosensitive drums 1*a* to 1*d*, an exposure device 5 for exposing image information on the photosensitive drums 1*a* to 1*d*, developing devices 3*a*, 3*b*, 3*c*, and 3*d* for forming toner images on the photosensitive drums 1*a* to 1*d*, and cleaning devices 7*a*, 7*b*, 7*c*, and 7*d* for removing developer (toner) and the like remaining on the photosensitive drums 1*a* to 1*d*.

When image data is inputted from a personal computer or another higher-level device, first, the surfaces of the photosensitive drums 1*a* to 1*d* are uniformly electrically charged by the electric chargers 2*a* to 2*d*, light is then radiated according to image data by the exposure device 5, and electrostatic latent images according to the image data are formed on the photosensitive drums 1*a* to 1*d*. The developing devices 3*a* to 3*d* are filled with a predetermined amount of a two-component developer, each of which devices containing a toner of the respective colors magenta, cyan, yellow, and black. When the percentage of toner in the two-component developer filling the developing devices 3*a* to 3*d* falls below a stipulated value due to the formation of the toner images described hereinafter, the developing devices 3*a* to 3*d* are replenished with toner from toner containers 4*a* to 4*d*. The toner in this developer is supplied onto the photosensitive drums 1*a* to 1*d* by the developing devices 3*a* to 3*d*, and the toner electrostatically adheres to the drums. Toner images are thereby formed according to the electrostatic latent images formed on the photosensitive drums 1*a* to 1*d* by exposure from the exposure device 5.

An electrical field is then created by primary transfer rollers 6*a* to 6*d* with a predetermined transfer voltage between the primary transfer rollers 6*a* to 6*d* and the photosensitive drums 1*a* to 1*d*, and the toner images of magenta, cyan, yellow, and black on the photosensitive drums 1*a* to 1*d* are primary-transferred onto the intermediate transfer belt 8. The images of these four colors are formed with a predetermined positional relationship established in advance in order to form a predetermined full color image. Then, in preparation for the continued formation of new electrostatic latent images, the toner and the like remaining on the surfaces of the photosensitive drums 1*a* to 1*d* is removed by the cleaning devices 7*a* to 7*d*.

The intermediate transfer belt 8 is placed over a transporting roller 10 on the upstream side and a drive roller 11 on the downstream side. When the intermediate transfer belt 8 begins to rotate clockwise along with the rotation of the drive roller 11 by a drive motor (not shown), the transfer paper P is transported at a predetermined timing from the pair of resist rollers 12*b* to the nip portion (a secondary transfer nip portion) between the drive roller 11 and the adjacent secondary transfer roller 9, and the full color image on the intermediate transfer belt 8 is transferred onto the transfer paper P. The transfer paper P on which the toner images have been transferred is transported to the fixing part 13.

The transfer paper P transported to the fixing part 13 is heated and pressurized by a pair of fixing rollers 13*a* to fix the toner images to the surface of the transfer paper P, and a predetermined full color image is formed. With the full color image formed on the transfer paper P, the transported direction of the transfer paper P is sorted by a diverging part 14 which diverges in multiple directions. When an image is formed on only one surface of the transfer paper P, the transfer paper P is ejected without any further action to an ejection tray 17 by a pair of ejection rollers 15.

When images are formed on both surfaces of the transfer paper P, the transfer paper P having passed through the fixing part 13 is temporarily transported toward the ejection rollers 15. After passing through the diverging part 14, the rear end of the transfer paper P causes the ejection rollers 15 to rotate in opposite directions and switches the transporting direction of the diverging part 14. As a result, the transfer paper P is sorted to an inverted transporting route 18 starting from the rear end, and the transfer paper P is transported back to the secondary transfer nip portion with the image surface inverted. The next toner images formed on the intermediate transfer belt 8 are then transferred by the secondary transfer roller 9 onto the surface of the transfer paper P on which the image is not formed. The transfer paper P is then transported to the fixing part 13 where the toner images are fixed, after which the transfer paper P is ejected to the ejection tray 17 by the pair of ejection rollers 15.

Figure 2:
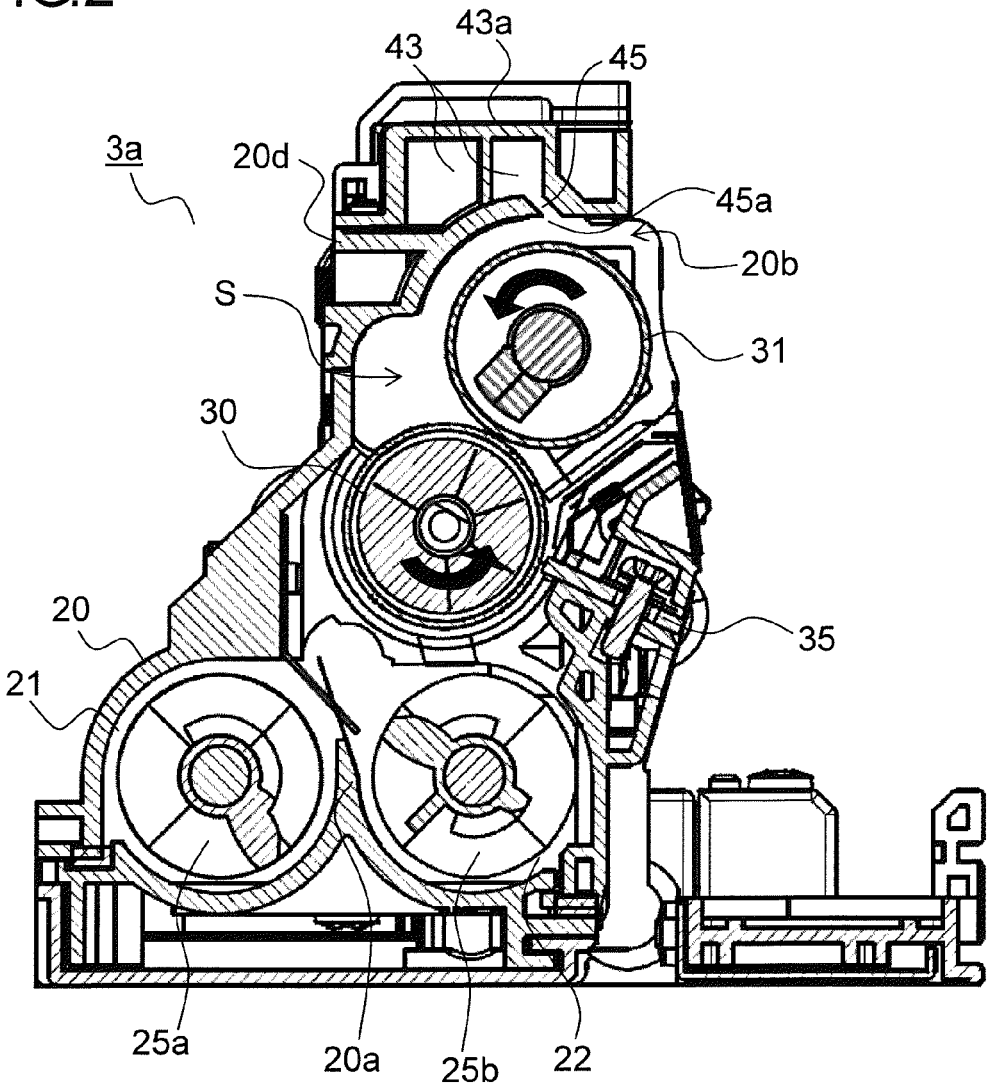
FIG. 2 is a side cross-sectional view of the developing device 3*a* of the first embodiment.
Figure 3:
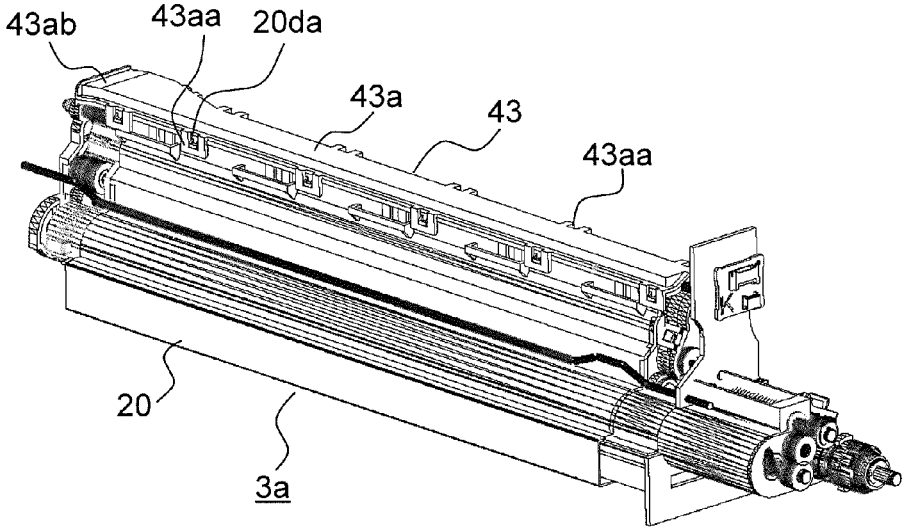
FIG. 3 is an external perspective view of the developing device 3*a* of the first embodiment as seen from the top left of FIG. 2.
Figure 4:
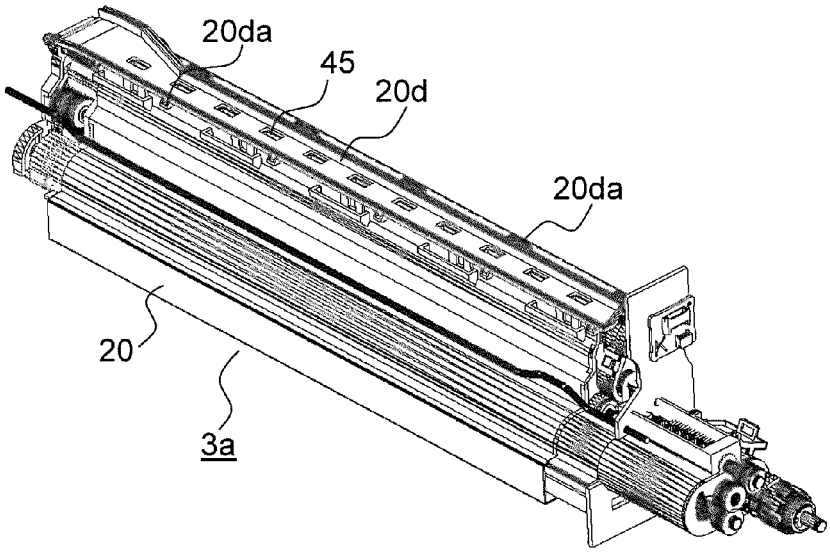
FIG. 4 is an external perspective view showing a state in which a duct cover 43*a* has been removed from the developing device 3*a* of FIG. 3.

FIG. 2 is a side cross-sectional view of the developing device 3*a* according to the first embodiment of the present disclosure, FIG. 3 is an external perspective view of the developing device 3*a* as seen from the top left of FIG. 2, and FIG. 4 is an external perspective view showing a state in which a duct cover has been removed from the developing device 3*a* of FIG. 3. FIG. 2 shows a state seen from the back surface side of FIG. 1, and the placement of the members inside the developing device 3*a* is the bilateral opposite of that in FIG. 1. The developing device 3*a* placed in the image formation part Pa of FIG. 1 is described here, but the configurations of the developing devices 3*b* to 3*d* placed in the image formation parts Pb to Pd are essentially the same and are therefore not described.

The developing device 3*a* comprises a developing container 20 for accommodating the two-component developer containing the magnetic carrier and toner (hereinbelow referred to simply as the developer), as shown in FIG. 2. The developing container 20 is sectioned into a stir/transport chamber 21 and a supply/transport chamber 22 by a partitioning wall 20*a*. Rotatably arranged in the stir/transport chamber 21 and the supply/transport chamber 22 are, respectively, a stir/transport screw 25*a* and a supply/transport screw 25*b* for mixing the toner (positively charged toner) supplied from the toner container 4*a* (see FIG. 1) with the magnetic carrier, stirring the mixture, and electrically charging the toner.

The developer is transported in the axial direction (the direction perpendicular to the image plane of FIG. 2) while being stirred by the stir/transport screw 25*a* and the supply/transport screw 25*b*. The developer is circulated between the stir/transport chamber 21 and the supply/transport chamber 22 via a developer passage (not shown) formed in both ends of the partitioning wall 20*a*. Specifically, a circulation channel for the developer is formed in the developing container 20 by the stir/transport chamber 21, the supply/transport chamber 22, and the developer passage.

The developing container 20 extends upward and to the right in FIG. 2, a magnetic roller (a developer carrier) 30 is placed above the supply/transport screw 25*b* inside the developing container 20, and a developing roller (a toner carrier) 31 is placed above and to the right of the magnetic roller 30 and made to face the magnetic roller 30. Part of the external peripheral surface of the developing roller 31 is exposed through an opening 20*b* in the developing container 20, and this part faces the photosensitive drum 1*a* (see FIG. 1). The magnetic roller 30 and the developing roller 31 both rotate counterclockwise in FIG. 2.

Placed in the stir/transport chamber 21 is a toner concentration sensor (not shown) which is directed toward the stir/transport screw 25*a*. Based on the sensory results of this toner concentration sensor, the stir/transport chamber 21 is replenished with toner from the toner container 4*a* through a toner replenish hole (not shown). The toner concentration sensor is a magnetic permeability sensor for detecting the magnetic permeability of the two-component developer composed of toner and a magnetic carrier within the developing container 20, for example.

The magnetic roller 30 is configured from a non-magnetic rotating sleeve which rotates counterclockwise in FIG. 2, and a fixed magnet having a plurality of magnetic poles contained within the rotating sleeve.

The developing roller 31 is configured from a cylindrical developing sleeve which rotates counterclockwise in FIG. 2, and a developing-roller-side magnetic pole fixed within the developing sleeve. The magnetic roller 30 and the developing roller 31 face each other across a predetermined gap in their facing positions. The developing-roller-side magnetic pole is heteropolar with the magnetic pole (the main pole) facing the fixed magnet.

Along the longitudinal direction of the magnetic roller 30 (the direction perpendicular to the image plane of FIG. 2), a restricting blade 35 is attached to the developing container 20. The restricting blade 35 is positioned upstream of the facing portion of the developing roller 31 and the magnetic roller 30, relative to the rotational direction of the magnetic roller 30 (counterclockwise in FIG. 2). A small space (gap) is formed between the tip of the restricting blade 35 and the surface of the magnetic roller 30.

DC voltage (referred to as Vslv (D) hereinbelow) and AC voltage (referred to as Vslv (AC) hereinbelow) are applied to the developing roller 31. DC voltage (referred to as Vmag (DC) hereinbelow) and AC voltage (referred to as Vmag (AC) hereinbelow) are applied to the magnetic roller 30. These DC and AC voltages are applied from a developing bias power source through a bias control circuit (neither are shown) to the developing roller 31 and the magnetic roller 30.

As previously described, the developer is circulated through the stir/transport chamber 21 and the supply/transport chamber 22 in the developing container 20 while being stirred by the stir/transport screw 25*a* and the supply/transport screw 25*b*, the toner is electrically charged, and the developer is transported to the magnetic roller 30 by the supply/transport screw 25*b*. A magnetic brush (not shown) is formed on the magnetic roller 30. The thickness of the magnetic brush on the magnetic roller 30 is regulated by the restricting blade 35, after which the magnetic brush is transported to the facing portion of the magnetic roller 30 and the developing roller 31. Having been transported to this portion, the magnetic brush forms a thin layer of toner on the developing roller 31 by the magnetic field and the difference of potential ΔV between the Vmag (DC) applied to the magnetic roller 30 and the Vslv (DC) applied to the developing roller 31.

The toner layer thickness on the developing roller 31 changes also due to the resistance of the developer, the difference in rotational speed between the magnetic roller 30 and the developing roller 31, and other factors, but the thickness can be controlled according to ΔV. The toner layer on the developing roller 31 becomes thicker when ΔV increases, and the toner layer becomes thinner when ΔV decreases. It is appropriate for the range of ΔV during developing to commonly be about 100 V to 350 V.

The thin toner layer formed on the developing roller 31 by the magnetic brush is transported by the rotation of the developing roller 31 to the facing portion of the photosensitive drum 1*a* and the developing roller 31 (the developing area). Because the Vslv (DC) and Vslv (AC) are applied to the developing roller 31, the toner is sprayed by the difference in potential with the photosensitive drum 1*a*, and the electrostatic latent image on the photosensitive drum 1*a* is developed.

The remaining toner not used in the developing is transported back to the facing portion of the developing roller 31 and the magnetic roller 30 by the rotation of the developing roller 31, and is recovered by the magnetic brush on the magnetic roller 30. The magnetic brush is then stripped away from the magnetic roller 30 in the homopolar portion of the fixed magnet, after which the magnetic brush falls down into the supply/transport chamber 22.

A predetermined amount of toner is then replenished from the toner replenishing hole (not shown) on the basis of the sensory results of the toner concentration sensor (not shown), and while circulating through the supply/transport chamber 22 and the stir/transport chamber 21, the toner becomes uniformly charged two-component developer with the proper toner concentration. This developer is supplied back to the magnetic roller 30 by the supply/transport screw 25*b*, forming a magnetic brush, and is then transported to the restricting blade 35.

Ducts 43 are placed above the developing container 20. The ducts 43 are formed by a top end 20*d* of the developing container 20 and a duct cover 43*a*. As shown in FIGS. 3 and 4, engaging holes 43*a* a projecting downward from the longitudinal side end edges (the far and near sides of the drawings) of the duct cover 43*a* engage with engaging pawls 20*da* formed in the top end 20*d*, whereby the duct cover 43*a* is fixed to the top end 20*d*. A linking part 43*a* b is formed in one end of the duct cover 43*a*, and the ducts 43 and a collecting duct 47 (see FIG. 5) are linked via the linking part 43*ab*.

The top end 20*d* is provided with air outflow channels 45 in communication with the interiors of the ducts 43 from an air outflow hole 45*a*. A plurality of the air outflow channels 45 are formed along the longitudinal direction of the developing container 20 so as to pass through the top end 20*d*, and the air in the developing container 20 is ejected from the air outflow holes 45*a* through the air outflow channels 45 into the ducts 43.

Figure 5:
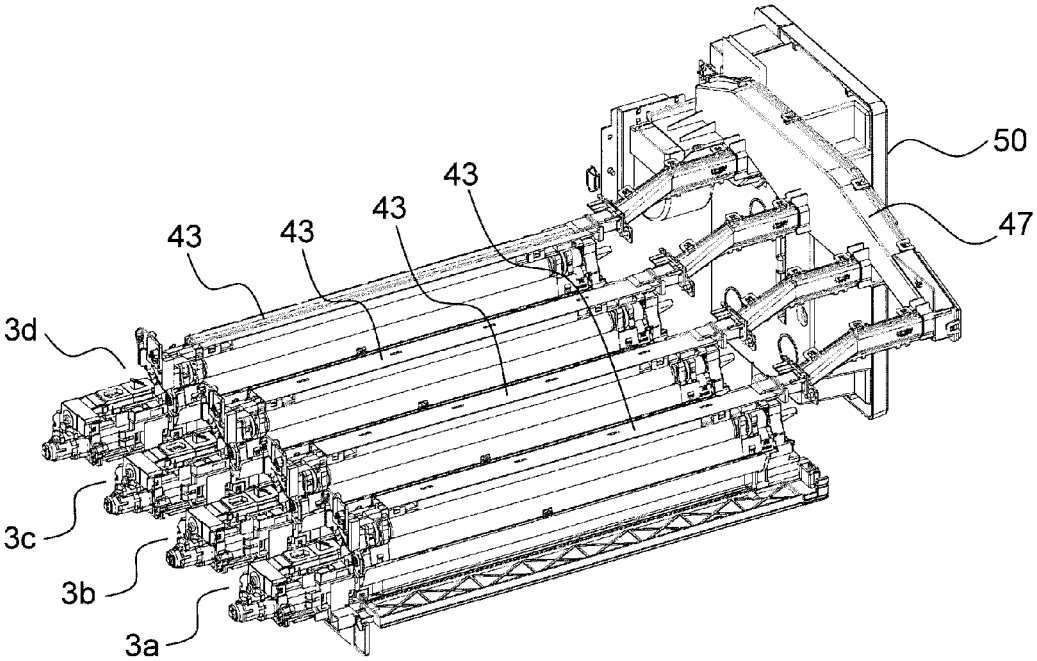
FIG. 5 is a perspective view showing airflow channels from the developing devices 3*a* to 3*d* of the first embodiment to a waste collector 50.
Figure 6:
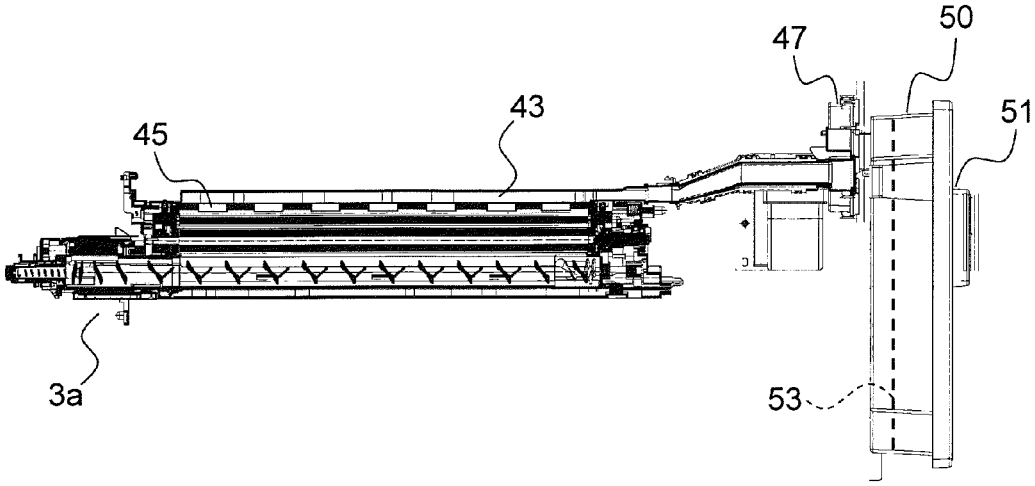
FIG. 6 is a side cross-sectional view showing the airflow channel from the developing device 3*a* of the first embodiment to the waste collector 50.

FIG. 5 is a perspective view showing airflow channels from the developing devices 3*a* to 3*d* to a waste collector 50, and FIG. 6 is a side cross-sectional view showing the airflow channel from the developing device 3*a* to the waste collector 50. The ducts 43 placed above the developing devices 3*a* to 3*d* are connected to the waste collector 50 via the collecting duct 47. An exhaust fan 51 is arranged on the waste collector 50, and a filter 53 is provided between the exhaust fan 51 and the collecting duct 47. The air ejected from the developing devices 3*a* to 3*d* through the air outflow channels 45 into the ducts 43 is mixed together by the collecting duct 47 and is ejected from the waste collector 50 out of the main body of the color printer 100. Because the toner drawn into the waste collector 50 with the air in the developing devices 3*a* to 3*d* is collected in the filter 53, there is no risk of the exterior of the color printer 100 being contaminated.

Figure 7:
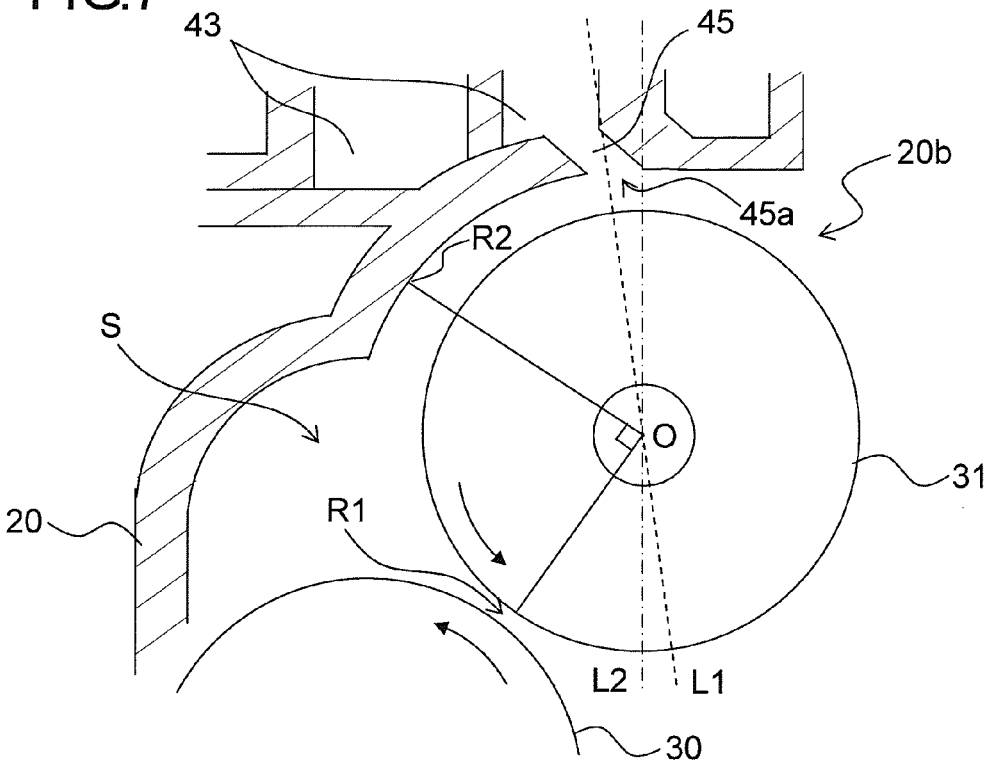
FIG. 7 is a partial enlarged view of the periphery of the developing roller 31 in FIG. 2.

FIG. 7 is a partial enlarged view of the upper vicinity of the facing portion R1 of the magnetic roller 30 and the developing roller 31 in FIG. 2. Inside the developing container 20, internal pressure increases in a space S enclosed by the external peripheral surface of the developing roller 31 upstream of the facing portion R1 of the developing roller 31 and magnetic roller 30 relative to the rotational direction of the developing roller 31, the external peripheral surface of the magnetic roller 30 downstream of the facing portion R1 relative to the rotational direction of the magnetic roller 30, and the internal peripheral surface of the developing container 20.

In the facing portion R1, because the toner not used in the developing is stripped away from the developing roller 31 by the magnetic brush of the magnetic roller 30, toner that has been stripped away and not recovered on the magnetic roller 30 floats into the space S. The faster the developing process, the greater the floated amount of the toner. Therefore, there is a risk that the toner floating in the space S will leak out from the opening 20*b* in the developing container 20 due to the internal pressure.

The air outflow holes 45*a* are preferably provided so as to face the space S in order to efficiently draw the toner floating in the space S into the ducts 43. However, when all of the floating toner in the space S is drawn in, the amount of toner drawn into the ducts 43 increases. As a result, problems occur such as the toner accumulating in the ducts 43, and the filter 53 of the waste collector 50 clogging earlier, increasing the frequency of replacement.

In view of this, in the present embodiment, the top end 20*d* of the developing container 20 positioned above the facing portion R1 of the developing roller 31 and the magnetic roller 30 is provided with the air outflow channels 45 communicating the interior of the developing container 20 and the ducts 43. Furthermore, the air outflow channels 45 are inclined downstream in the rotational direction of the developing roller 31 (to the left in FIG. 7), relative to a straight line L1 passing through the rotational axis center O of the developing roller 31 and the air outflow holes 45*a*.

Figure 8:
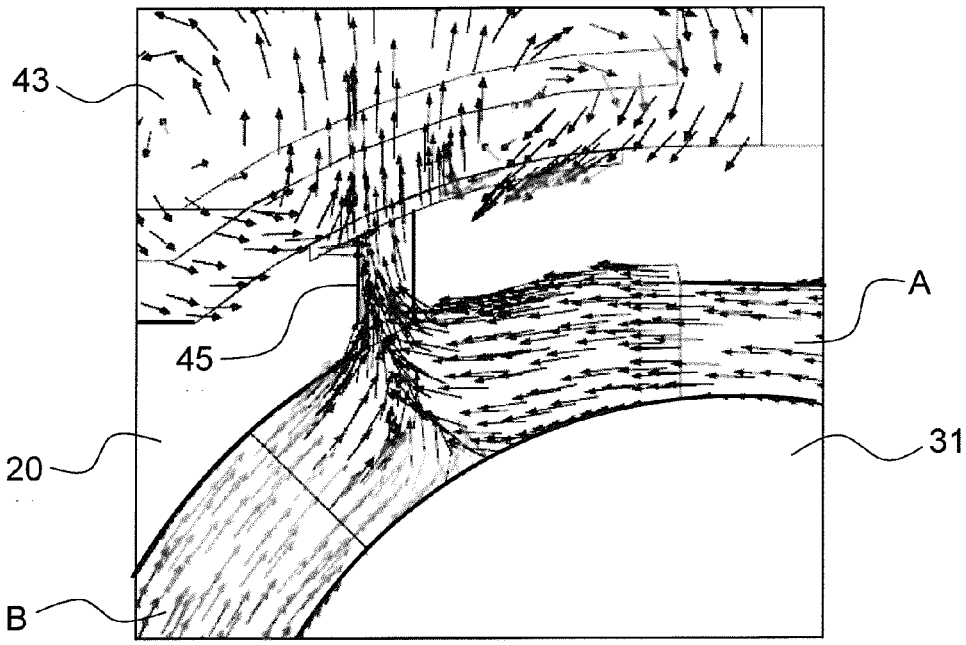
FIG. 8 is a simulation drawing showing the direction of airflow above the developing roller 31 in a conventional configuration in which the air outflow channels 45 are formed vertically.
Figure 9:
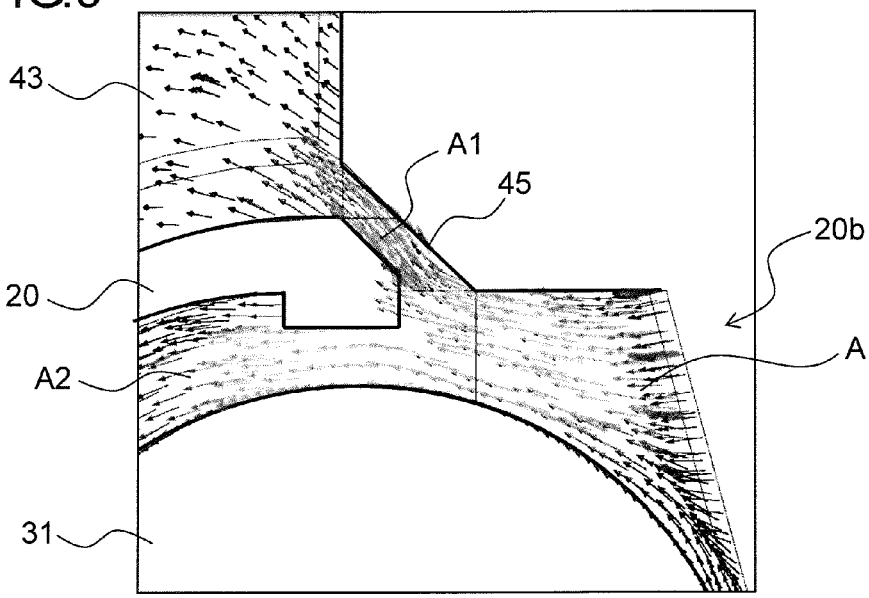
FIG. 9 is a simulation drawing showing the direction of airflow above the developing roller 31, in the configuration of the present disclosure wherein the air outflow channels 45 are inclined downstream in the rotational direction of the developing roller 31.

FIG. 8 is a simulation drawing showing the direction of airflow above the developing roller 31 in a conventional configuration in which the air outflow channels 45 are formed vertically, and FIG. 9 is a simulation drawing showing the direction of airflow above the developing roller 31, in the configuration of the first embodiment wherein the air outflow channels 45 are inclined downstream in the rotational direction of the developing roller 31. In FIGS. 8 and 9, the darkness and lightness of the arrows indicate the difference in speed of the airflow, and the darker portions have a faster flow rate than the lighter portions.

When the air outflow channels 45 are formed vertically as shown in FIG. 8, there can be seen an airflow A traveling from the opening 20*b* side of the developing container 20 (the right in FIG. 8), passing through the space between the developing container 20 and the developing roller 31, and heading toward the air outflow channels 45, and an airflow B traveling from the direction of the space S (the lower left in FIG. 8), passing through the space between the developing container 20 and the developing roller 31, and heading toward the air outflow channels 45. Therefore, the toner floating in the space S is also taken into the air outflow channels 45 along with the airflow B, and a large amount of toner is drawn into the ducts 43.

When the air outflow channels 45 are inclined downstream in the rotational direction of the developing roller 31 (to the left in FIG. 7) as shown in FIG. 9, the airflow A, which is taken into the space between the developing container 20 and the developing roller 31 through the opening 20*b* of the developing container 20, diverges into an airflow A1 heading toward the air outflow channels 45 and an airflow A2 heading in the direction of the space S. Between the two, the airflow A2 heading in the direction of the space S functions as an air curtain blocking the flow of floating toner from the space S to the air outflow channels 45. Therefore, little of the toner floating in the space S is drawn into the ducts 43, merely due to the toner scattered to the developing area periphery being drawn in along with the airflow A1.

Consequently, according to the configuration of the present embodiment, excessive toner floating in the space S can be suppressed from being drawn into the air outflow channels 45, and the toner floating in the space S can be effectively prevented from leaking out from the opening 20*b*. The toner floating in the space S naturally falls onto the magnetic roller 30 with the passage of time, to be taken up by the magnetic brush.

When the air outflow holes 45*a* are too near the space S, there is a risk of a large amount of the toner floating in the space S being drawn in. When the air outflow holes 45*a* are near the facing area (the developing area) of the developing roller 31 and the photosensitive drum 1*a* and toner has accumulated in the air outflow channels 45, there is a risk of the accumulated toner falling out from the opening 20*b* of the developing container 20.

Therefore, it is preferable that the air outflow holes 45*a* be provided to a position that is farther upstream than a position R2 distanced 90° upstream from the facing portion R1 of the magnetic roller 30 and the developing roller 31 relative to the rotational direction of the developing roller 31, and that is also downstream in the rotational direction of the developing roller 31 (to the left in FIG. 7) relative to a vertical line L2 passing through the rotational axis center O of the developing roller 31, as shown in FIG. 7. This makes it possible to prevent a large amount of the toner floating in the developing container 20 from being drawn in by the air outflow holes 45*a* being too far inside the developing container 20, and also to prevent the toner accumulated in the air outflow channels 45 from falling out from the opening 20*b* of the developing container 20 due to the air outflow holes 45*a* being too near the developing area.

Figure 10:
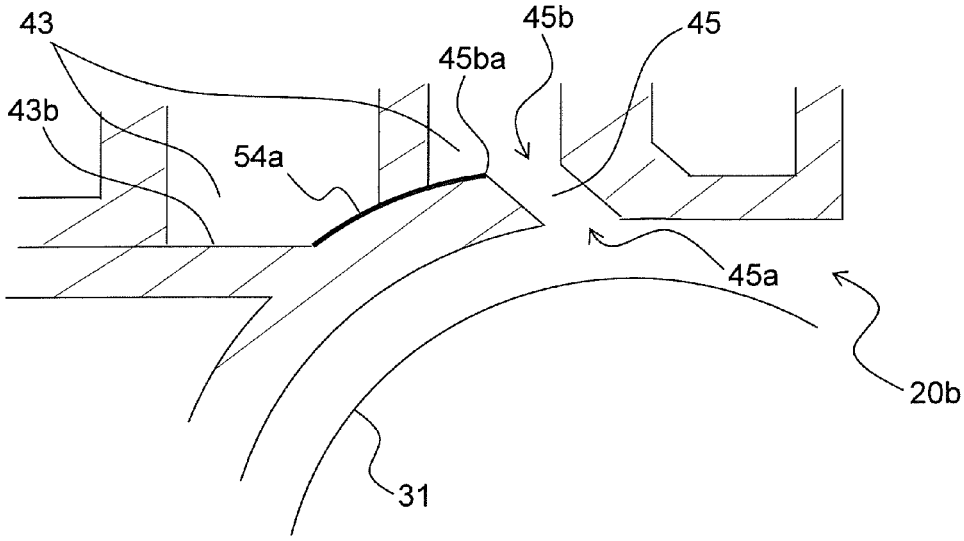
FIG. 10 is a partial enlarged view of the periphery of the air outflow channel 45 in FIG. 7.

FIG. 10 is a partial enlarged view of the periphery of the air outflow channel 45 in FIG. 7. As shown in FIG. 10, an airflow inlet 45*b* in the duct 43 communicated with the air outflow channel 45 is formed higher than the lowest part 43*b* of the bottom surface in the duct 43, and an open edge 45*b* a of the airflow inlet 45*b* and the lowest part 43*b* are linked by an inclined surface 54*a* (shown by the bold line in FIG. 10). With this configuration, even if the toner drawn into the duct 43 through the air outflow channel 45 seems likely to accumulate in the periphery of the airflow inlet 45*b*, the toner slides down the inclined surface 54*a* and accumulates on the lowest part 43*b*, and it is therefore possible to prevent the toner from stopping up the airflow inlet 45*b* and the air outflow channel 45 from being closed up.

Figure 11:
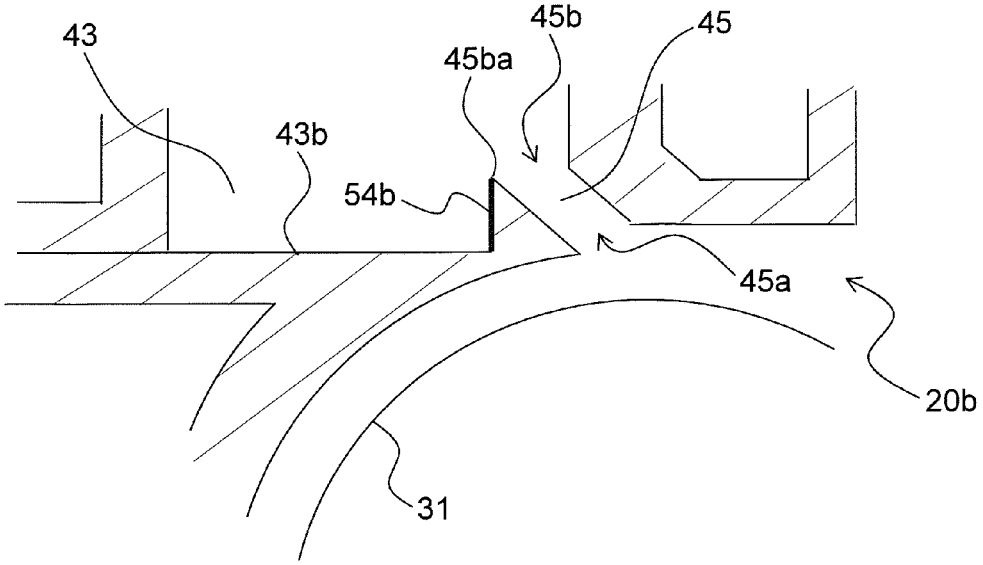
FIG. 11 is a partial enlarged view showing another configuration of the periphery of the air outflow channel 45.
Figure 12:
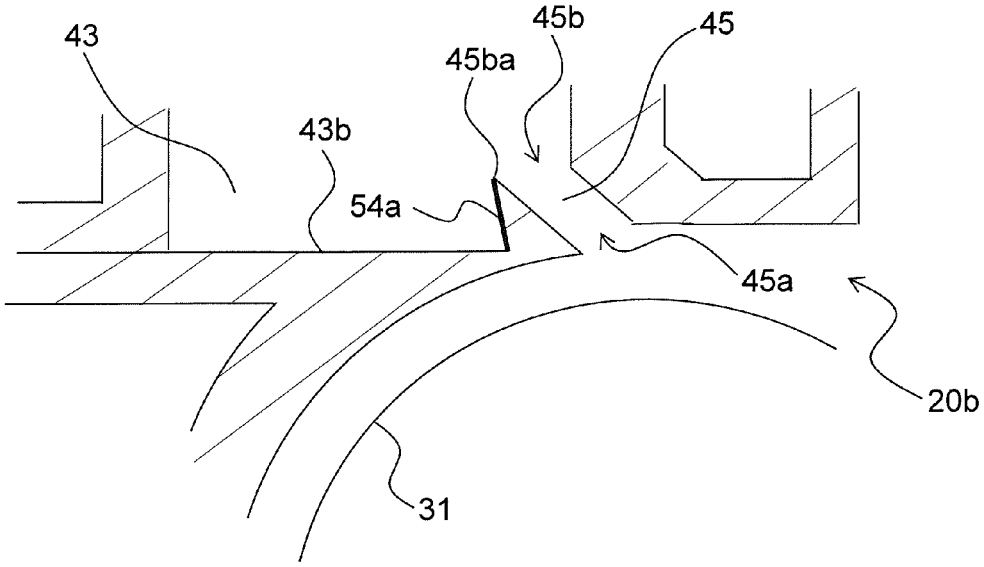
FIG. 12 is a partial enlarged view showing yet another configuration of the periphery of the air outflow channel 45.

The open edge 45*b* a and the lowest part 43*b* may be linked by a vertical surface 54*b* as shown in FIG. 11, or the inclined surface 54*a* linking the open edge 45*b* a and the lowest part 43*b* may be inclined in the opposite direction (toward the air outflow channel 45) as shown in FIG. 12. In these configurations as well, toner that seems likely to accumulate in the periphery of the airflow inlet 45*b* slides down the inclined surface 54*a* or the vertical surface 54*b* and accumulates on the lowest part 43*b*.

Specifically, toner contamination inside or outside the color printer 100 caused by the toner leaking from the developing devices 3*a* to 3*d* can be effectively prevented by installing the developing devices 3*a* to 3*d* of the present embodiment. Toner accumulation in the ducts 43 is suppressed, as is clogging of the filter 53, and the color printer 100 has improved maintainability.

Because the developing devices 3*a* to 3*d* are long and thin in shape, a flow rate difference arises in the airflow heading from the air outflow channels 45 to the ducts 43 in the longitudinal direction of the developing container 20 (the left-right direction in FIG. 3). Specifically, the airflows at a faster rate in the end on the side with the linking part 43*a* b (the left side in FIG. 3) near the exhaust fan 51, and the airflows at a slower rate in the end on the opposite side (the right side in FIG. 3).

Therefore, when the airflow heading from the air outflow channels 45 to the ducts 43 is adjusted to an appropriate flow rate in the side with the linking part 43*a* b, the flow rate is insufficient in the end on the opposite side (the right side in FIG. 3). In the portion with an insufficient flow rate, it is not possible to sufficiently form an air curtain for blocking the flow of floating toner from the space S toward the air outflow channels 45, and there is a risk that the floating toner will leak out from the opening 20*b*. When the airflow is adjusted to an appropriate flow rate in the end on the side with an insufficient flow rate (the right side in FIG. 3), the flow rate becomes excessive in the side with the linking part 43*ab*. In the portion with an excessive flow rate, an airflow arises which heads from the space S toward the air outflow channels 45, toner floating in the space S is drawn into the ducts 43, the ducts 43 are readily stopped up, and the filter 53 are readily clogged.

Figure 13:
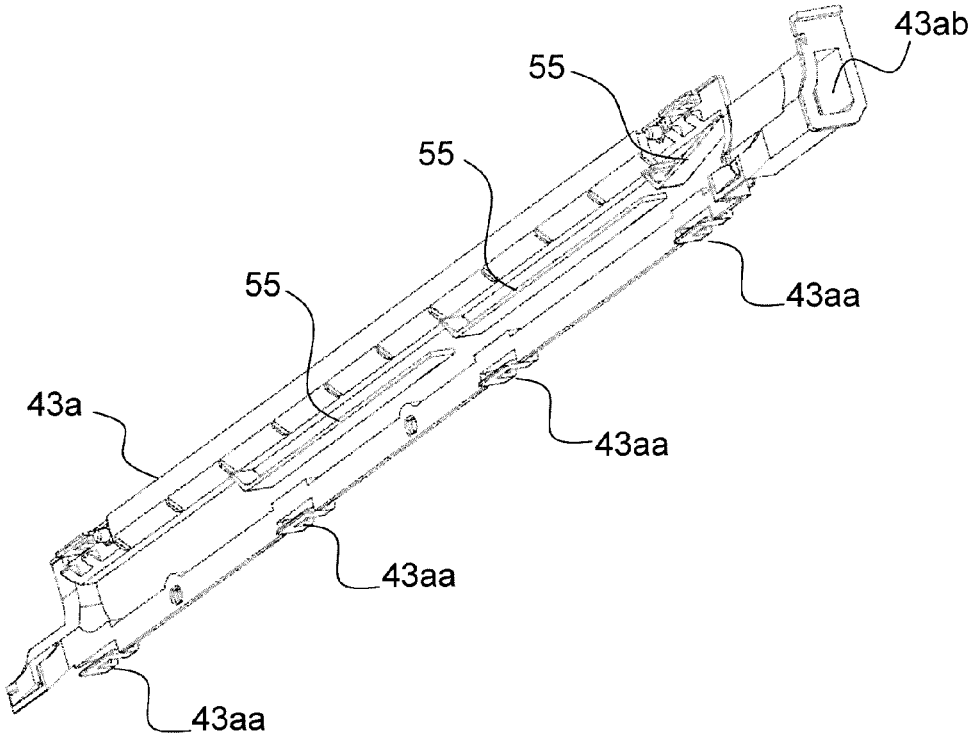
FIG. 13 is a perspective view from the rear side of the duct cover 43*a* mounted on the developing devices 3*a* to 3*d* of the first embodiment.

In view of this, in the present embodiment, baffle plates 55 are provided to the inner surface of the duct cover 43*a* as shown in FIG. 13. The baffle plates 55 protrude into the ducts 43 when the duct cover 43*a* is mounted on the top end part 20*d* of the developing container 20 and the ducts 43 are formed, and the baffle plates 55 divide the interiors of the ducts 43 into a plurality of flow channels in the longitudinal direction. Thereby, the flow rate of the air flowing through the ducts 43 is substantially uniform throughout the entire longitudinal direction of the ducts 43, the flow rate difference in the airflow in the longitudinal direction of the ducts 43 is eliminated, and it is possible to suppress the leaking of toner from the opening 20*b* due to an insufficient flow rate, as well as the drawing in of a large amount of toner into the ducts 43 due to an excessive flow rate.

When the baffle plates 55 are placed in parallel inside the ducts 43, the intervals between the baffle plates 55 must be expanded so that the toner drawn into the ducts 43 does not become stopped up, the cross-sectional area of the ducts 43 increases, and the space in which the ducts 43 are placed is larger. In view of this, a plurality of baffle plates 55 are placed so as to mostly lie on the same straight line along the longitudinal direction of the ducts 43, whereby the interiors of the ducts 43 can be divided into a plurality of flow channels without expanding the cross-sectional area of the ducts 43, as shown in FIG. 13.

Figure 14:
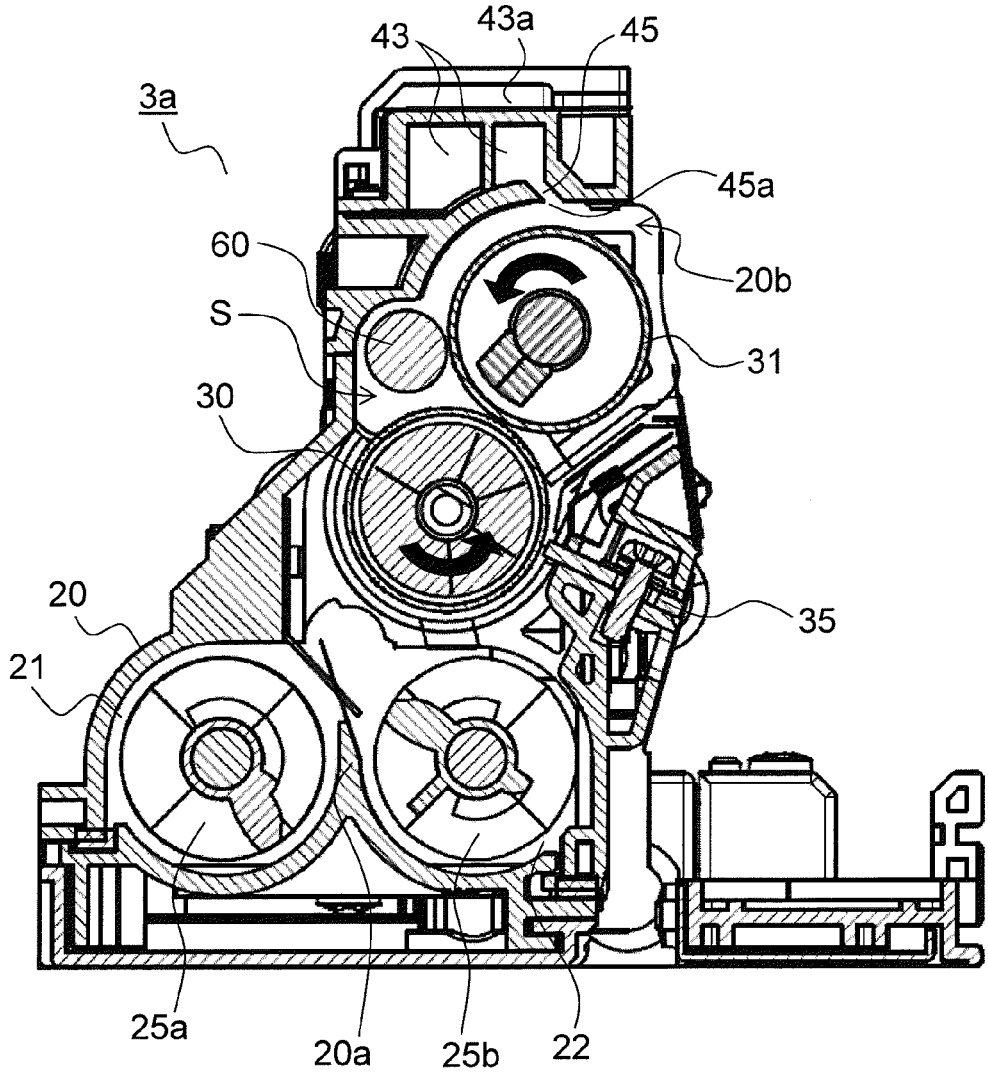
FIG. 14 is a side cross-sectional view of the developing device 3*a* according to the second embodiment of the present disclosure.

FIG. 14 is a side cross-sectional view of the developing device 3*a* according to the second embodiment of the present disclosure. Shared components in FIG. 2 are denoted by the same symbols and are not described. In the present embodiment, a roller-shaped filler member 60 is provided in the space S. The configurations of the other portions of the developing device 3*a* are the same as those of the first embodiment and are therefore not described.

According to the configuration of the present embodiment, the volume of the space S, which is enclosed by the magnetic roller 30, the developing roller 31, and the internal peripheral surface of the developing container 20, can be less than in the first embodiment. Consequently, there is a smaller space S in which floats toner that has been stripped away from the developing roller 31 and not recovered on the magnetic roller 30, there is less toner floating in the space S, and leaking of toner from the opening 20*b* can therefore be more effectively suppressed.

The material and shape of the filler member 60 are not particularly limited, but when a resinous filler member 60 is used, friction with the developer causes the filler member 60 to take on static electricity, and the toner sometimes electrostatically adheres to and accumulates on the filler member 60. There is then a risk of image flaws occurring due to "dropping toner," when clumps of accumulated toner fall down onto the magnetic roller 30 or the developing roller 31. Therefore, it is preferable to use a filler member 60 made of metal not susceptible to taking on an electrostatic charge, and to fashion the filler member 60 into a roller shape that has a curved surface and that is not susceptible to accumulating toner. When the filler member 60 is rotated, an airflow arises due to the rotation of the filler member 60 and the flow of air inside the developing container 20 becomes complex, and the filler member 60 therefore preferably has a roller shape and does not rotate.

Electrostatic adhesion of the toner to the filler member 60 can be effectively prevented by forming the filler member 60 from a metal, an electroconductive resin, or another electroconductive material, and applying a DC bias of the same polarity as the toner (positive) to the filler member 60. Consequently, it is possible to effectively prevent the occurrence of image flaws caused by the toner falling phenomenon, wherein toner that has accumulated on the filler member 60 and formed clumps falls down onto the magnetic roller 30 or the developing roller 31.

The present disclosure is not limited to the embodiment described above, and various modifications can be made within a range that does not deviate from the scope of the present disclosure. For example, the shapes, sizes, and other features of the air outflow channels 45 and the ducts 43 presented in the above embodiments can be appropriately set according to the amount of toner floating in the developing container 20, the shape conditions of the airflow channels, the output of the exhaust fan 51, and other factors, and these features are not particularly limited.

As long as the configuration has a developing device installed which comprises a magnetic roller 30 for carrying a two-component developer and a developing roller 31 for carrying only toner, as shown in FIG. 2, the present disclosure is not limited to the tandem color printer 100 shown in FIG. 1 and can be applied to other image forming apparatuses, such as monochrome and color copying machines, digital multifunction printers, FAX devices, and the like, for example.

The present disclosure can be utilized in a developing device which uses a two-component developer containing a magnetic carrier and a toner, and which uses a developer carrier for carrying the developer and a toner carrier for carrying only the toner. Utilizing the present disclosure makes it possible to effectively prevent toner contamination of the image forming apparatus interior caused by toner leaking from the developing device, and also to reduce the amount of toner drawn into the ducts for drawing in toner floating in the developing device, and the maintainability of the image forming apparatus can therefore be improved.

What is claimed is:

1. A developing device comprising:

a developing container for accommodating a two-component developer containing a magnetic carrier and a toner;

a toner carrier having some of an external peripheral surface exposed through an opening in the developing container, whereby the toner carrier is arranged so as to face an image carrier, the toner carrier supplying toner to the image carrier while rotating so that the surface facing the image carrier moves upward;

a developer carrier which is placed facing the toner carrier, the developer carrier rotating so that a surface facing the toner carrier moves in the opposite direction of the toner carrier, and a toner layer being formed on the toner carrier using a magnetic brush comprising a two-component developer carried on a surface of the developer carrier;

a regulating member for regulating the amount of developer carried on the developer carrier; and an air outflow channel for communicating an airflow outlet formed in a top end of the developing container facing the toner carrier with the interior of a duct placed above the developing container, the air outflow channel being inclined downstream in the rotational direction of the toner carrier relative to a straight line passing through the rotational axis center of the toner carrier and the airflow outlet, wherein the airflow outlet is provided to a position, relative to the rotational direction of the toner carrier, that is farther downstream than a vertical line passing through the rotational axis center of the toner carrier, and that is farther upstream than a position distanced 90° upstream from the facing portion of the developer carrier and the toner carrier.

2. The developing device of claim 1, wherein there is placed a filler member for reducing the volume of a space enclosed by the external peripheral surface of the toner carrier farther upstream in the rotational direction of the toner carrier relative to the facing portion of the toner carrier and the developer carrier, the external peripheral surface of the developer carrier farther downstream in the rotational direction of the developer carrier relative to the facing portion, and the internal peripheral surface of the developing container.

3. The developing device of claim 2, wherein the filler member is formed from an electroconductive material.

4. An image forming apparatus comprising:

the developing device of claim 1;

the duct communicated with the air outflow channel provided to the developing device;

exhaust means for creating an airflow inside the duct and ejecting the air in the developing container out of the main body of the apparatus; and a filter for collecting toner that has passed through the duct along with the air in the developing container, the filter being placed toward the side of the duct from which the airflow is ejected.

5. The image forming apparatus of claim 4, wherein a plurality of the air outflow channels are provided across the entire longitudinal direction of the developing container, and baffle plates for dividing the duct interior into a plurality of flow channels in the longitudinal direction are provided inside the duct.

6. The image forming apparatus of claim 5, wherein the baffle plates are placed on substantially the same line along the longitudinal direction of the duct.

7. The image forming apparatus of claim 4, wherein an airflow inlet of the duct communicated with the air outflow channels is formed higher than the lowest part of the bottom surface in the duct, and an open edge of the airflow inlet and the lowest part of the bottom surface are linked by an inclined surface or a vertical surface.

8. A developing device comprising:

a developing container for accommodating a two-component developer containing a magnetic carrier and a toner;

a toner carrier having some of an external peripheral surface exposed through an opening in the developing container, whereby the toner carrier is arranged so as to face an image carrier, the toner carrier supplying toner to the image carrier while rotating so that the surface facing the image carrier moves upward;

a developer carrier which is placed facing the toner carrier, the developer carrier rotating so that a surface facing the toner carrier moves in the opposite direction of the toner carrier, and a toner layer being formed on the toner carrier using a magnetic brush comprising a two-component developer carried on a surface of the developer carrier;

a regulating member for regulating the amount of developer carried on the developer carrier; and an air outflow channel for communicating an airflow outlet formed in a top end of the developing container facing the toner carrier with the interior of a duct placed above the developing container, the air outflow channel being inclined downstream in the rotational direction of the toner carrier relative to a straight line passing through the rotational axis center of the toner carrier and the airflow outlet, wherein there is placed a filler member for reducing the volume of a space enclosed by the external peripheral surface of the toner carrier farther upstream in the rotational direction of the toner carrier relative to the facing portion of the toner carrier and the developer carrier, the external peripheral surface of the developer carrier farther downstream in the rotational direction of the developer carrier relative to the facing portion, and the internal peripheral surface of the developing container, the filler member is formed from an electroconductive material, and a bias of the same polarity as the toner is applied to the filler member.

9. A developing device comprising:

a developing container for accommodating a two-component developer containing a magnetic carrier and a toner;

a toner carrier having some of an external peripheral surface exposed through an opening in the developing container, whereby the toner carrier is arranged so as to face an image carrier, the toner carrier supplying toner to the image carrier while rotating so that the surface facing the image carrier moves upward;

a developer carrier which is placed facing the toner carrier, the developer carrier rotating so that a surface facing the toner carrier moves in the opposite direction of the toner carrier, and a toner layer being formed on the toner carrier using a magnetic brush comprising a two-component developer carried on a surface of the developer carrier;

a regulating member for regulating the amount of developer carried on the developer carrier; and an air outflow channel for communicating an airflow outlet formed in a top end of the developing container facing the toner carrier with the interior of a duct placed above the developing container, the air outflow channel being inclined downstream in the rotational direction of the toner carrier relative to a straight line passing through the rotational axis center of the toner carrier and the airflow outlet, wherein there is placed a filler member for reducing the volume of a space enclosed by the external peripheral surface of the toner carrier farther upstream in the rotational direction of the toner carrier relative to the facing portion of the toner carrier and the developer carrier, the external peripheral surface of the developer carrier farther downstream in the rotational direction of the developer carrier relative to the facing portion, and the internal peripheral surface of the developing container, and the filler member has the shape of a roller and not rotating.

* * * * *